US007690172B2

(12) United States Patent
Denis

(10) Patent No.: US 7,690,172 B2
(45) Date of Patent: Apr. 6, 2010

(54) METHOD AND APPARATUS FOR SEALING CONTAINER

(76) Inventor: Basilisio Denis, CMO Maldonado 5130 (UY)

( * ) Notice: Subject to any disclaimer, the term of this patent is extended or adjusted under 35 U.S.C. 154(b) by 0 days.

(21) Appl. No.: 12/173,130

(22) Filed: Jul. 15, 2008

(65) Prior Publication Data

US 2010/0011713 A1 Jan. 21, 2010

(51) Int. Cl.
*B65B 7/28* (2006.01)

(52) U.S. Cl. ..... 53/366; 53/367; 53/485

(58) Field of Classification Search ..... 53/485, 53/486, 285, 300, 305, 329, 366, 367
See application file for complete search history.

(56) References Cited

U.S. PATENT DOCUMENTS 2,555,194 A * 5/1951 Kojan et al. ..... 7/138
2,767,537 A * 10/1956 Prince et al. ..... 53/366
2,768,491 A * 10/1956 Gatheridge ..... 53/310
2,845,765 A * 8/1958 Doherty ..... 53/366
3,369,342 A * 2/1968 Tessitore ..... 53/366
3,530,637 A * 9/1970 Rezner et al. ..... 53/488
4,102,113 A * 7/1978 Raque et al. ..... 53/366
4,170,862 A * 10/1979 Lazure ..... 53/471
4,180,959 A * 1/1980 Hempel et al. ..... 53/334
4,683,706 A * 8/1987 Harper ..... 53/485

* cited by examiner

*Primary Examiner*—Paul R Durand
(74) *Attorney, Agent, or Firm*—Collen IP; Donald J. Ranft

(57) ABSTRACT

This invention is a device and method to seal covers on containers such as food containers. But it can be used to seal containers for other products also. Its design allows its configuration for use on containers and covers of different sizes and shapes.

3 Claims, 5 Drawing Sheets

METHOD AND APPARATUS FOR SEALING CONTAINER

BACKGROUND OF INVENTION

1. Field of Invention

The present invention relates to a device and method for sealing a cover on a container. It more particularly relates to facilitating the easy uniform sealing of covers on typically food containers but can be used on containers for other items also.

2. Description of Prior Art

Many different types of containers are used by restaurants to allow patrons to bring home food which they do not finish. Many of these containers consist of an aluminum container and a cardboard or plastic top. The covers can be flat or raised to provide more space to accommodate the food. The lip of the container is then manually folded over the flat cover or a lip on the raised cover. This manual folding takes time and is not uniform and may not securely seal the container.

SUMMARY OF THE INVENTION

This invention provides a device and method for uniformly and securely folding the lip of a container over on top of a flat cover or a lip on a raised cover. It may be configured to handle containers and covers of different shapes, sizes and materials. The typical food container is an aluminum container with a paper based or plastic cover.

NUMERICAL LIST OF PARTS

Figure 1:
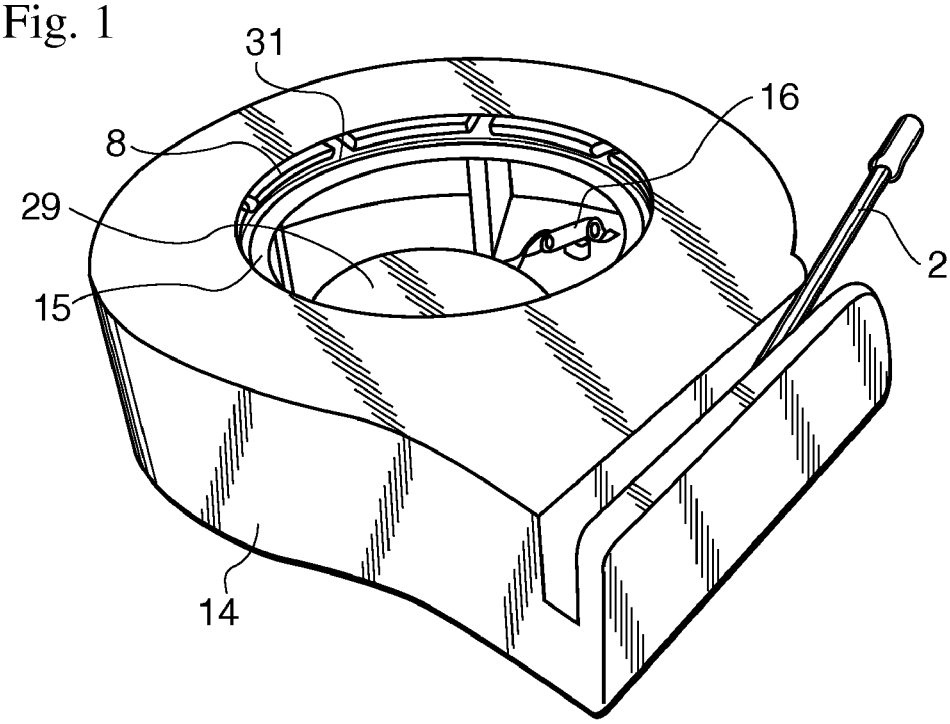
FIG. 1 is a front perspective view of an embodiment of the device with no container or cover and handle shown in resting position.
Figure 2:
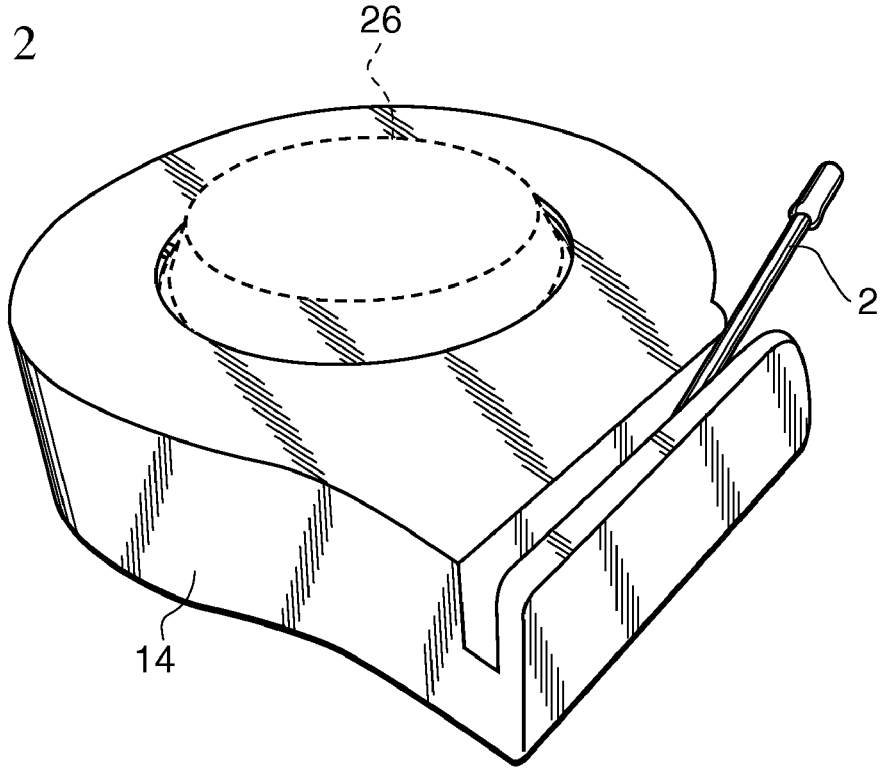
FIG. 2 is a front perspective view of an embodiment of the device with a container and cover.
Figure 3:
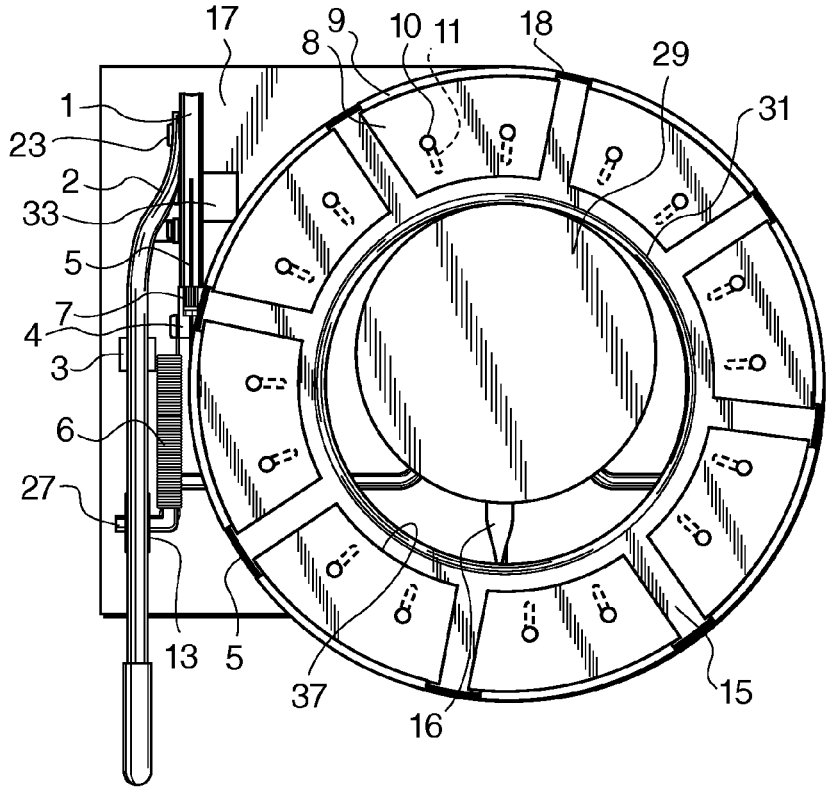
FIG. 3 is a top view of an embodiment of the device with handle and container tray in resting position.
Figure 4:
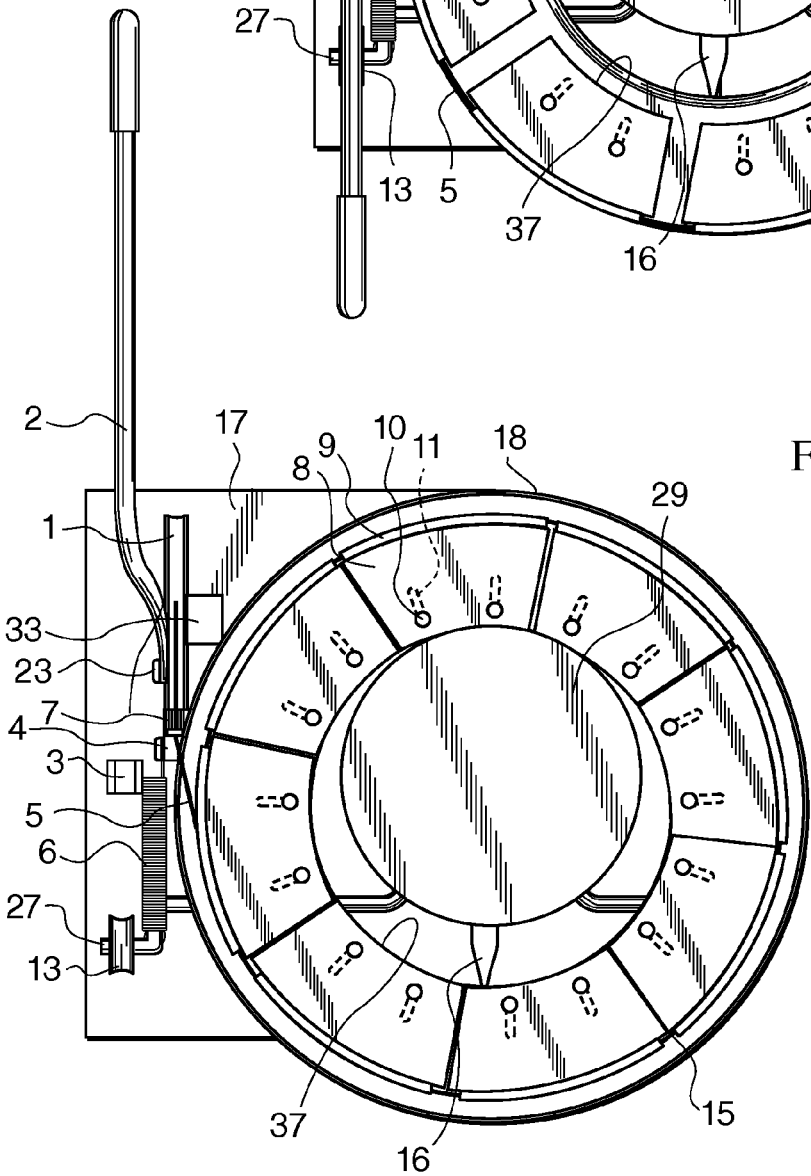
FIG. 4 is a top view of an embodiment of the device with squash plates fully extended as the result of handle rotation.
Figure 5:
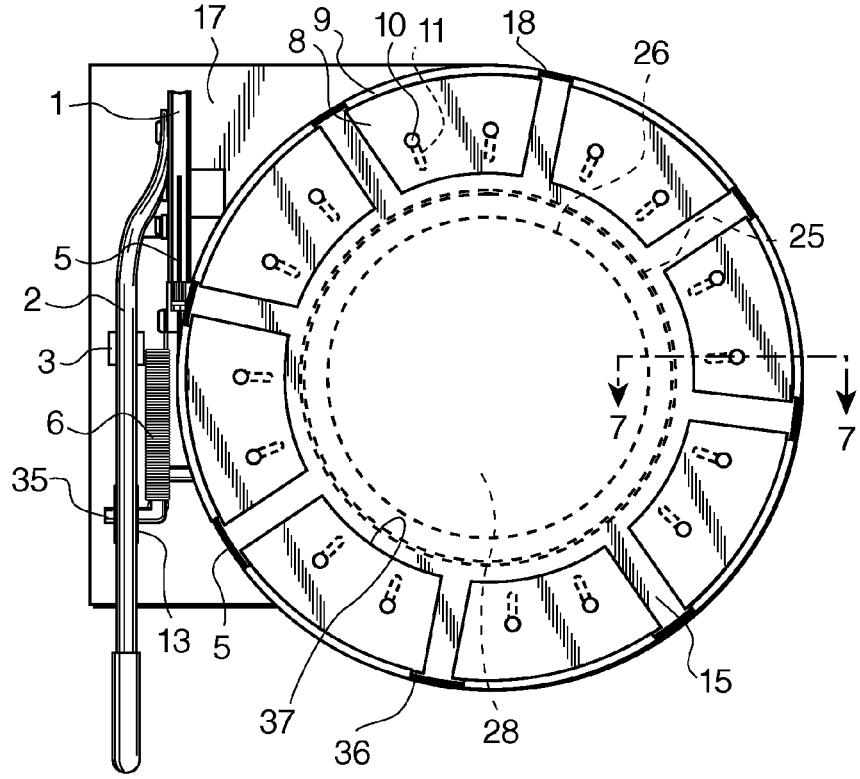
FIG. 5 is the same view as FIG. 3 with a container inserted.
Figure 6:
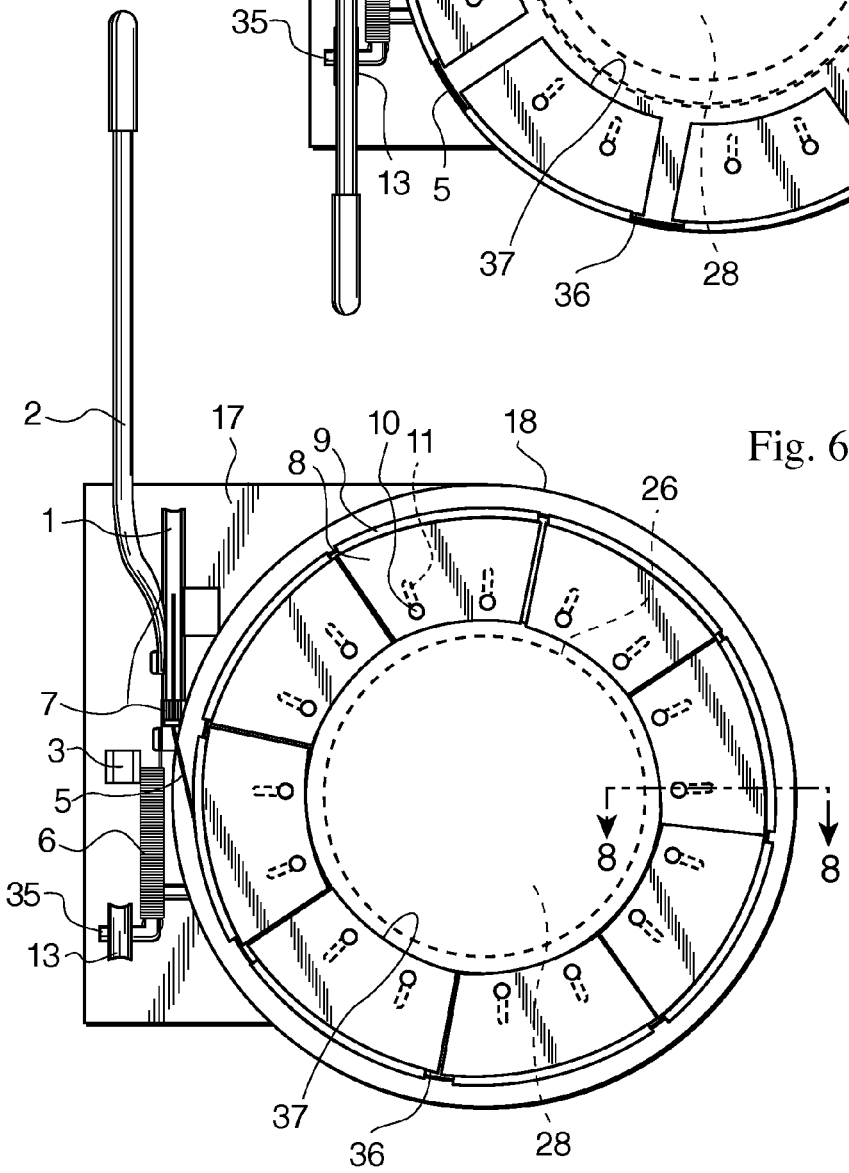
FIG. 6 is the same view as FIG. 4 with a container inserted.

1. Cable Wheel
2. Handle
3. Handle Clip
4. Cable Barrel Mount
5. Cable
6. Pinion Spring
7. Cable Adjustment Barrel
8. Squash Plate
9. Cable Guide
10. Plate Bolt
11. Plate Slot

12. Pinion end cover
13. Roller
14. External Shell
15. Main Plate
16. Container Tray Horizontal Strut
17. Skin Bottom
18. Main Plate Side
19. Plate Block
20. Plate Spring
21. Plate Screw
22. Plate Nut
23. Handle Bolt
24. Main Plate Inner Edge
25. Cover Lip
26. Cover
27. Container Lip
28. Container
29. Container Tray
30. Container Tray Strut
31. Main Plate Container Stop
32. Main Plate Support
33. Cable Roller Wheel Support
34. Container and Sealed Cover
35. Pinion Arm
36. Squash Plate Outer Edge
37. Squash Plate Inner Edge

DESCRIPTION OF INVENTION

This device and method can be configured to be used on containers and covers of various sizes, shapes and materials. FIGS. 1-11 depict a device configured to be used on one of the most commonly used food containers consisting of a round typically aluminum container with a raised plastic cover. The shape of the main plate (19) along with its central hole; the shape, number, and configuration of the squash plates (8); and the configuration and location of the plate blocks (19) can all be modified to accommodate containers and covers of different shapes and materials.

As depicted on the Figures, the device includes an external shell (14) with an opening in a central location for insertion of a container (28) and cover (26). The operation of the device as depicted in FIGS. 1-11 requires loading a container (28) with cover (26) positioned on the container tray (29). A circular main plate ((15) with a hole in its center sized to allow entry of the intended container size to be sealed, is mounted on main plate supports which are secured to the inside bottom on the external shell (14). Squash plates (8) are arranged on the main plate (15.

Each squash plate is secured by a plate bolt (10) and plate nut (22) to a plate block (19). The plate blocks (19) are positioned in plate slots (11) located on the main plate (15). Plate springs (20) are secured at one end to the main plate (15) and at its other end to the plate block (19). Plate screws (21) secure each end of the plate springs (20). The squash plates (8) are arranged to form a circle whose diameter is controlled by the spacing between the squash plates (8). When the diameter of the circle is at its maximum, the inner edge of the squash plates (37) are further away from the center of the main plate's (15) center hole than the outer edge of a depression on the inner edge (24) of the main plate. The minimum diameter of the circle formed by the squash plates (8) is essentially the same as the diameter of the hole in the main plate (15).

Figure 7:
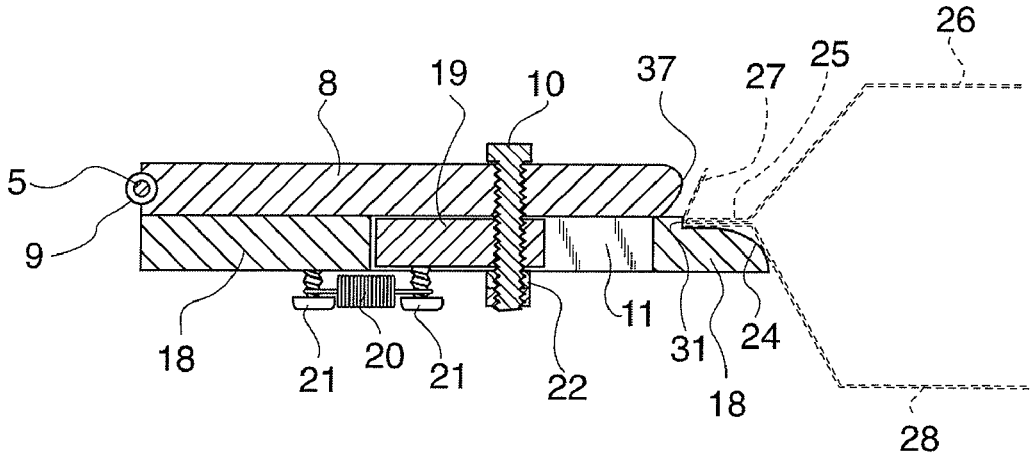
FIG. 7 is a cross sectional view of FIG. 5.
Figure 8:
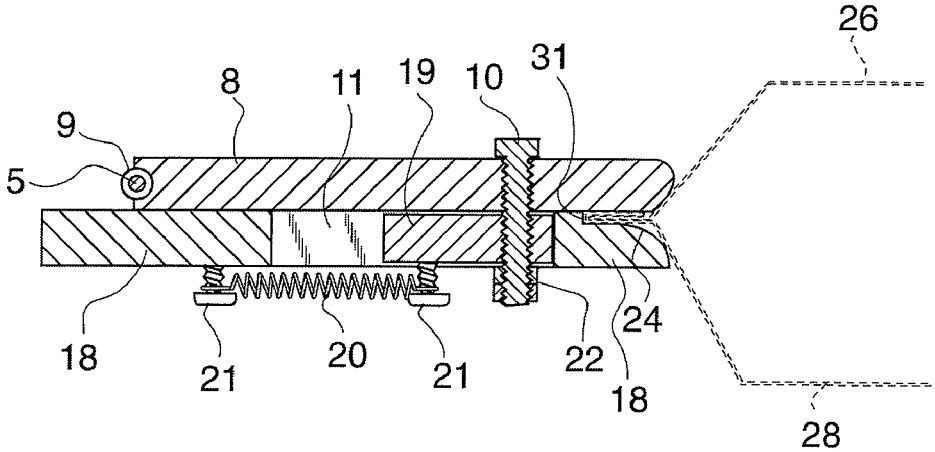
FIG. 8 is a cross sectional view of FIG. 6.
Figure 9:
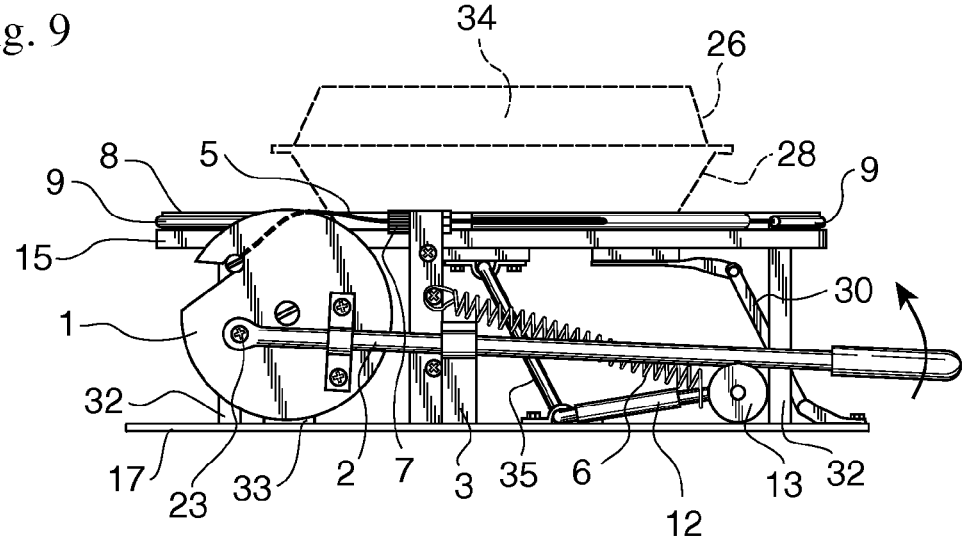
FIG. 9 is a cross sectional view of the operating mechanism in the container ejection mode with a cover sealed on a container.

With the device in its resting position plate springs (20) hold each squash plate (8) withdrawn from each other and from the center of the device. FIG. 7 is a cross-section with the squash plate (8) and main plate (15) in resting position. FIG. 8 is the same cross-section with the squash plate moved toward the center of the device by retraction of the cable (5) onto the cable wheel (1). This movement of the squash plate bends the container lip (27) over on top of the cover lip (25). The main plate edge (24) holds the container (28) in place while the sealing operation is performed. The main plate (15) provides a container stop (31) and a depression in the main plate (15) for insertion of the container lip (22) and cover lip (25). The depth of the depression in the main plate (15) is sized such that the container lip (27) folded over on top of a flat cover or cover lip (27) to be flush with the top surface of the main plate (15).

The counterclockwise rotation of the handle (2) pulls the cable (5) which draws squash plates (8) closer to each other and the inner edges of the squash plates (37) toward the center of the device forcing the container lip (27) to be folded down on top of the cover lip (25). Return of the handle (2) to its resting position allows the squash plates (8) to withdraw to their resting position and releasing the sealed container.

Figure 10:
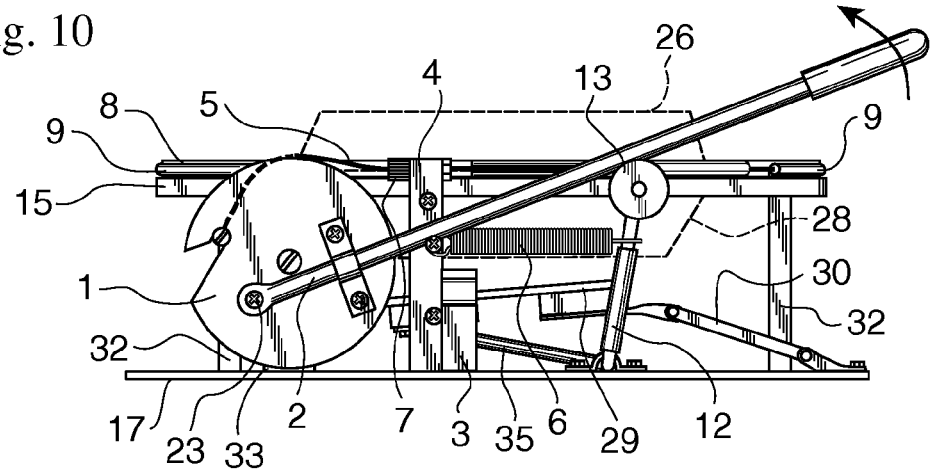
FIG. 10 is a cross sectional view of the operating mechanism in the starting position with a container and cover prior to sealing.
Figure 11:
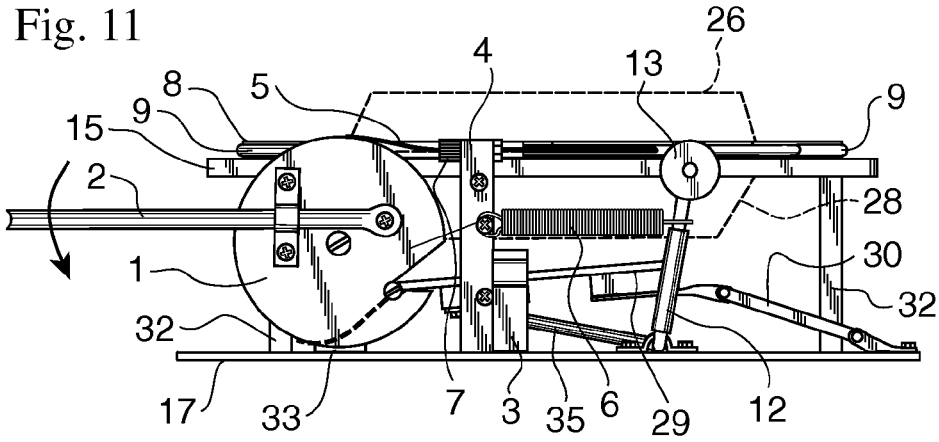
FIG. 11 is a cross sectional view of the operating mechanism in the sealing position.

When the device is in its resting position, the handle (2) is at about 30 degrees from horizontal as shown on FIG. 10. In this position the handle (2) rests on the roller (13) which is held in position by the pinion spring (6) and the container tray (29) is in its lowest position. The pinion arm (35) is secured to the inside bottom of the external shell (14) with clips allowing its rotation. As depicted on FIG. 9, clockwise rotation of the handle from its resting position to approximately a horizontal position presses down on a roller (13) which is mounted on one end of the pinion arm (35) causing the pinion arm (35) to rotate and raise the container tray (29) which is secured on the other end of the pinion arm (35). A container tray strut (30) with one or more joints designed to allow movement when the tray is raised and lowered provides additional support for the tray. With the handle in an approximately horizontal position it is held there by a handle clip (3) to secure the tray in place while containers are placed on the tray or removed. The pinion arm (35) is held in the resting position by a pinion spring (6) with one end attached to the pinion arm (35) and the other end to a cable barrel mount (4) which is secured to the inside bottom of the external shell and on which the cable adjustment barrel (7) is secured.

As depicted on the Figures, the cable (5) is secured to the cable wheel (1) and passes through a cable adjustment barrel (4) and into a cable guide (9) which is secured to the outer edge of each squash plate (36). The cable (5) is secured at its second end to the exit point from the last cable guide (9) through which the cable (5) passes through. The cable wheel (1) is bolted at its center to a post which is secured to the inside bottom on the external shell. The cable wheel (1) is rotated around its center by movement of the handle (2) causing the cable (5) to be coiled onto the cable wheel (1) as the handle (2) is rotated counterclockwise.

In another embodiment of this invention a motor drive replaces the manual mechanism to rotate the cable wheel and the pinion arm. The motor drive is actuated switches and is powered by an electric power source as required. Limit switches are utilized to stop the motor when the cable wheel and pinion arm are in the required positions.

The description above and accompanying figures are presented as examples of the present invention. It is recognized that departures from the disclosed embodiments may be made within the scope of this invention and that obvious modifications will occur to a person skilled in the art. Other variations of the present invention are possible to meet a particular application. For example the number, size, and shape of the main and squash plates can be modified to be used to seal containers and covers of different configurations.

The invention claimed is:

1. A container sealing device comprising:

an external shell with an opening in a central location;

a container tray located in the central location and secured to one end of a pinion arm which is secured to the inside of a bottom on the external shell by clips allowing its rotation;

a tray strut with a minimum of one joint allowing movement and secured at one of its ends to the tray with its other end secured to the inside bottom of the external shell;

a roller mounted on a second end of the pinion arm;

a handle secured at one end to a cable wheel and in a resting position rests on the roller;

the cable wheel secured at its center to a post mounted on the inside bottom of the external shell;

a cable secured at one of its ends to the cable wheel;

the cable leaving the cable wheel passing through a cable adjustment barrel and entering into a cable guide attached to a minimum of three squash plates;

the cable adjustment barrel secured to a cable guide mount which is secured to the inside bottom of the external shell;

a tray spring secured at one of its ends to the cable barrel mount and its other end to the pinion arm whereby with the spring is in its resting position the pinion roller maintains the handle in its resting position;

a circular main plate mounted on a minimum of three main plate supports which are secured to the inside bottom of the external shell;

a main plate having a hole in its center sized to allow an unfolded lip on a container to rest on a depression on the inner edge of the main plate;

the squash plates resting on the main plate and arranged to form a circle whose diameter is controlled by the spacing between the squash plates;

the hole formed in the center of the squash plates being its maximum diameter with the cable withdrawn from the cable wheel allowing the maximum spacing between the squash plates;

at its maximum diameter an inner edge of the squash plates being further away from the center of the main plate's hole than an outer edge of the depression on an inner edge of the main plate;

the minimum diameter of the inner edge of the squash plates being the same as the diameter of the hole in the center of the main plate; and the squash plates being secured to a minimum of one plate block positioned to slide in a plate slot on the main plate wherein each plate block is secured to one end of a plate spring and a second end of the plate spring is secured to the main plate such that the spring is a rest when the diameter of the circle formed by the squash plate is at its maximum.

2. A container sealing device according to claim 1 wherein the depth of the depression on the main plate's inner edge is sized to allow the container lip folded on top of a cover lip to be flush with the top surface of the main plate.

3. A container sealing device according to claim 1 wherein the handle is replaced by a motor drive to cause the rotation of the pinion arm and cable wheel; and powered by an electric power source and controlled by manual switches and limit switches.

* * * * *